United States Patent [19]

Bongort et al.

[11] 4,165,501

[45] * Aug. 21, 1979

[54] POSITION SENSING SYSTEM

[75] Inventors: Edgar A. Bongort, Southfield; William T. Cruickshank, Pontiac, both of Mich.

[73] Assignee: B/W Controls Inc., Birmingham, Mich.

[ * ] Notice: The portion of the term of this patent subsequent to Nov. 8, 1994, has been disclaimed.

[21] Appl. No.: 845,294

[22] Filed: Oct. 25, 1977

[51] Int. Cl.[2] ..... H01H 36/00

[52] U.S. Cl. ..... 335/206; 335/153; 340/686

[58] Field of Search ..... 335/206, 207, 205, 153; 340/686; 200/84 C; 73/313

[56] References Cited

U.S. PATENT DOCUMENTS

| | | | |
|---|---|---|---|
| 4,056,979 | 11/1977 | Bongort et al. | 73/313 |
| 4,064,755 | 12/1977 | Bongort et al. | 200/84 C |

*Primary Examiner*—Harold Broome

*Attorney, Agent, or Firm*—Burton, Parker and Schramm

[57] ABSTRACT

A position sensing system having one or more magnetically operated switches at predetermined spaced locations and a magnet attached to a carrier moving along a path adjacent thereto and as the carrier passes each switch, magnetically latching it in one condition until the carrier returns in the opposite direction and unlatches it. The switches may be unlatched open or latched closed, or any combination, as the carrier travels past the switches in one direction and shifted to the opposite condition when the carrier moves in the opposite direction.

14 Claims, 10 Drawing Figures

POSITION SENSING SYSTEM

FIELD OF INVENTION

This invention relates to position sensing apparatus, in particular machine control systems of a type having a plurality of vertical or horizontal protective tubes containing magnetic proximity switches and a carrier movable adjacent the tubes as the workpiece is processed and in passing the switches actuating them.

BACKGROUND OF THE INVENTION

Certain prior art relating to liquid level control systems was cited and discussed in our earlier application Ser. No. 627,518, filed Oct. 31, 1975, now U.S. Pat. No. 4,056,979. From these disclosures it is known in the art to provide a control system comprising a plurality of reed switches disposed spaced apart to be actuated by a magnet conveyed by a carrier moveable along a path adjacent the switches. The following United States Patents are representative of such teaching:

U.S. Pat. No. 3,198,902
U.S. Pat. No. 3,200,645
U.S. Pat. No. 3,484,774
U.S. Pat. No. 3,634,794
U.S. Pat. No. 3,646,293
U.S. Pat. No. 3,678,750
U.S. Pat. No. 3,788,340
U.S. Pat. No. 3,826,139.

A problem common to each of these is that while the reed switch is closed as the carrier moves past, as for example to indicate carrier position, the switch opens as soon as the carrier magnet passes by the switch. Consequently, the only time a circuit will be completed through the reed switch is when the carrier magnet is sweeping it, and in order to be useful the reed switch must therefore be electrically connected to a memory system which is undisturbed by the switch opening as the carrier continues to move past. One available solution as shown in U.S. Pat. No. 3,826,139, involves the use of a guide tube having a plurality of floats, one for each reed switch, in a liquid level sensor. The various floats each require a stop located immediately above and below the switch to arrest the float upon activation of the switch. As the liquid continues to rise above the float, the float remains in the activating position until the level again drops. This system is costly because of the number of floats and stops required and appears limited in its application to liquid level sensing. The practicality of providing a number of magnet carriers along a machine control sensing system would be highly inefficient.

Another solution is proposed by U.S. Pat. No. 3,198,902 using a self-latching reed switch. However, in order for the switch to operate properly the magnet must bypass the reed switch through a specific sensing area shown in FIG. 3 of the patent. Thus the magnet and switch in U.S. Pat. No. 3,198,902 cannot revolve relative to each other imposing serious limitations on design flexibility. In the invention disclosed in the present application the actuating magnet and reed switches can revolve relative to each other, thus substantially increasing the design flexibility of the system in adapting it to various machine control environments.

The prior art illustrating systems using reed switches in combination with a memory system are generally unacceptable as creating problems during a power failure. If such a power failure occurs, the reed switch/memory system combination immediately loses track of the location of the magnet carrier when the power returns, whereas the present invention retains its preexisting condition.

SUMMARY OF THE INVENTION

We have overcome these objections to the prior art and in addition have obtained other positive advantages by providing a machine control system in which, when the carrier passes a switch, the switch is magnetically actuated to a different contact condition which is maintained despite ongoing movement of the carrier past the switch. When the carrier returns and passes the switch moving in the opposite direction, it will magnetically actuate the switch to return the contacts to their initial condition. The design of the switches is such that they need not be rotationally held in a given position adjacent the path of carrier movement and thus the design requirements and cost of construction of the sensing system are both more flexible and substantially reduced respectively as compared with the prior art. As a result of this it is possible to provide a plurality of switches arranged at various longitudinally spaced apart distances within one or more tubes and longitudinally positioned therein merely by a longitudinal adjusting element, and a single carrier moving along a path adjacent the tube or tubes which will successively actuate and latch each switch it passes while moving in one direction, for example, and then successively unlatch each switch it passes as it moves in the opposite direction. Thus, the need for latching relays in the switch circuits is eliminated and the mounting and longitudinal adjustability of the switches is greatly simplified.

Our switches may be constructed to provide different operating modes in the various tubes, viz., one switch may be unlatched open and another latched closed and as the carrier travels in one direction along the tube, each switch may have its contacts shifted to the opposite condition.

To carry out the invention, magnetic proximity switches of the reed type are disposed in a protective tube for actuation in response to the sweep of a magnetic field as the carrier moves past the switches. Unlike the prior art machine controls utilizing reed switches, the reed switches of this invention remain latched open or closed, as desired. We have shown various ways of providing a magnetic bias field for accomplishing this; each requiring a certain combination and arrangement of parts.

According to one approach, a conventional reed switch having normally open contacts, is provided with a small bias magnet of a strength insufficient alone to close the contacts, but once closed, sufficient to hold them closed. A magnet means conveyed by the carrier is so arranged as to provide a symmetrical toroidal magnetic field having leading and trailing magnetic fields of opposite direction, viz., leading and trailing in relation to carrier movement along the switch, and "opposite direction" having reference to the direction of the magnetic lines of flux. When the direction of the trailing field of the carrier magnet sweeping the reed switch augments or complements the direction of the bias magnet field, the reed switch is thereupon closed and remains closed under the influence of the bias magnet though the carrier proceeds beyond the switch. The switch remains closed until the carrier magnet again approaches from the opposite direction and the direction of the trailing field opposes the direction of the bias magnet field, whereupon the switch will open and remain open though the carrier continues to move therebeyond. We have shown four approaches for obtaining different closing patterns by changing the arrangement of the bias magnet or by the addition of another reed switch. Each pattern is dependent upon the actuation of the switches by the magnet's leading and trailing fields of opposite direction.

BRIEF DESCRIPTION OF PREFERRED EMBODIMENT

Figure 1:
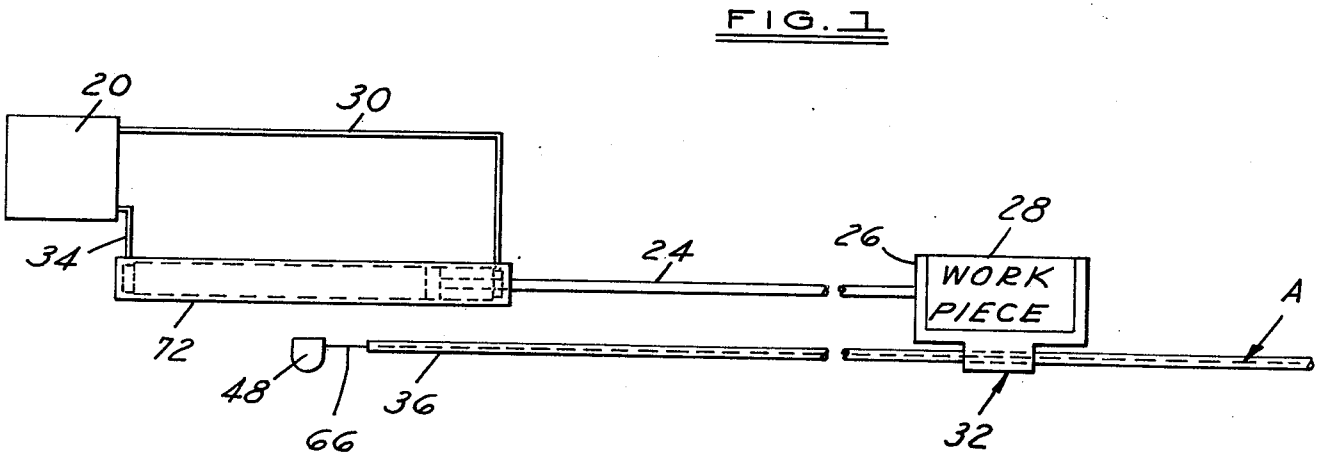
FIG. 1 is a schematic plan view of a position sensing system embodying our invention.

FIG. 1 schematically depicts an installation of our sensing system in a machine having a pump 20 driving a hydraulic cylinder 72 propelling carrier 26 longitudinally. The carrier 26 supports a workpiece 28 or the like for movement along a path parallel to the longitudinal axis of the reed switches. The sensing system is intended to signal positions of the carrier, as, for example, by actuating one or more lamps during travel of the carrier in one direction, and which are extinguished when the carrier moves in the opposite direction.

Movement of the carrier 26 is provided by pump 20, lines 30 and 34, hydraulic cylinder 72, and piston 24. Upon activation of pump 20 and line 34, hydraulic fluid is injected into the rear of hydraulic cylinder 72 propelling piston 24 and thereby carrier 26, longitudinally forward. Activation of pump 20 and line 30 injects hydraulic fluid into the forward chamber of hydraulic cylinder 72 thereby forcing piston 24 and carrier 26 rearward.

Figure 1A:
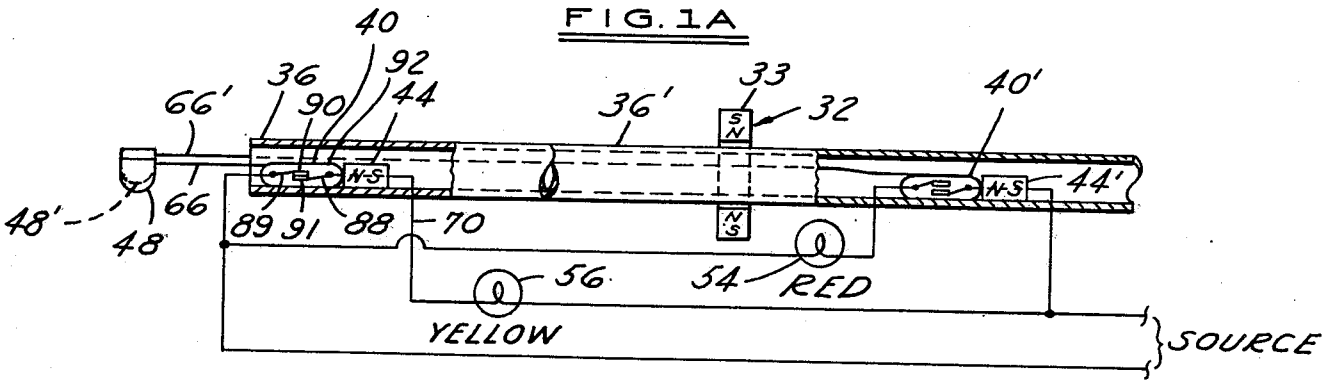
FIG. 1A schematically illustrates the position sensing means and a responsive circuit.
Figure 2:
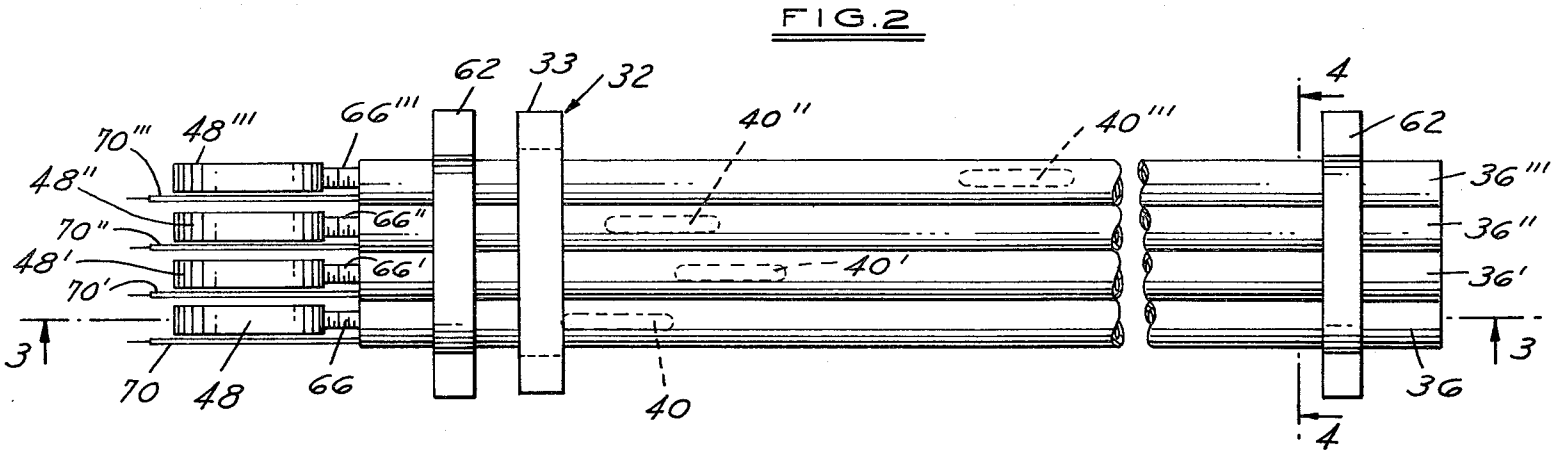
FIG. 2 is a side view of a position sensing system embodying our invention.
Figure 4:
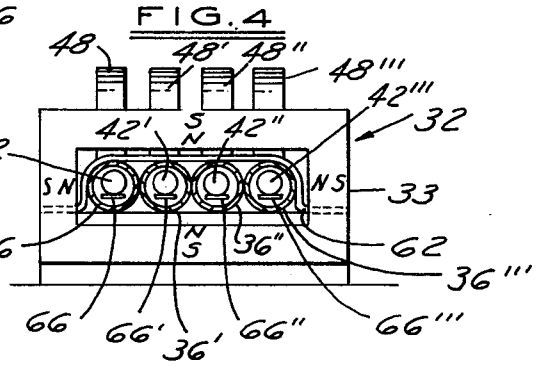
FIG. 4 is a cross-sectional view taken on the line 4—4 of FIG. 2.

Magnet means 32 is fixedly attached to carrier 26 and comprises a magnet 33 (see FIG. 1A) constructed and arranged to create a symmetrical toroidal magnetic field having an axis extending parallel to the axis of the reed switches at A, and leading and trailing field portions of opposite direction (i.e., leading and trailing with respect to carrier movement). The symmetrical toroidal magnetic field of magnet 33 surrounds the switches and sweeps one or more of the reed switches as the carrier travels along a path adjacent to the switches. Two such reed switches 40 and 40' are shown in FIG. 1A and are swept by the symmetrical toroidal magnetic field as the carrier reciprocates longitudinally. The figure shows the switches within protective tubes 36 and 36'. Such tubes 36 through 36''' are shown in FIGS. 2 and 4 and are retained adjacent one another by brackets 62. The tubes are made of non-magnetic material such as austenitic stainless steel or plastic and are open on either end depending upon the desired access to switches 40. Because of the similarity in these corresponding parts, such parts will be indicated by primed numerals and will generally be described by reference to one numeral.

FIG. 1A shows switches 40 and 40' each comprising a conventional reed switch normally having a glass envelope 92 within which are positioned a pair of flexible magnetic reeds or contacts 88, 89 of low permanence with one reed extending from each end of the envelope and with the reeds having overlapping contact faces 90, 91 substantially midway of the envelope. When a magnet field of sufficient strength is impressed across the contacts, it will cause them to close and when the magnet field is removed the contacts 88, 89 open. In other words, the contacts 88, 89 are spring biased so that they are normally open and are closed when exposed to a magnet field of sufficient strength. The switches 40 have no inherent magnetic latching capability of their own. As shown in the drawing, we have provided a magnetic bias field by associating a small bias or latching magnet 44 with each reed switch 40 having the magnet poles or magnetic axis arranged parallel to the axis of the reed switch. In addition, the bias magnet 44 can be placed alongside the switch with the axis of its poles parallel to the axis of the switch.

Figure 3:
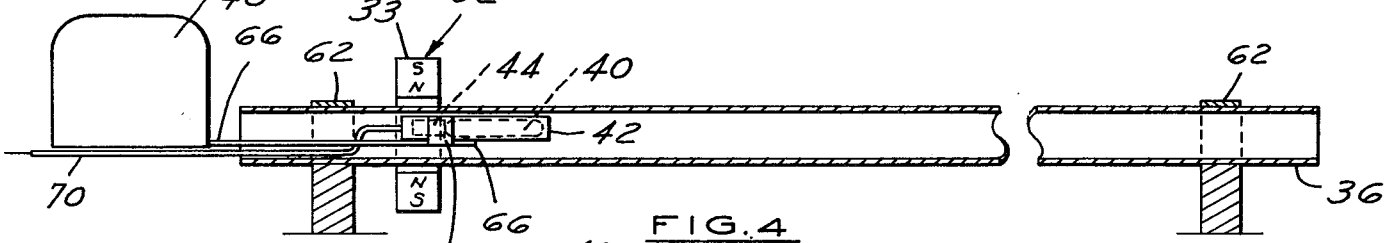
FIG. 3 is a cross-sectional view of the position sensing system of FIG. 2 taken on the line 3—3 thereof.

The particular type of reed switch assembly well adapted for this embodiment is shown in our earlier application, Ser. No. 627,518, filed Oct. 31, 1975, and now U.S. Pat. No. 4,056,979 and FIG. 3 of the present application. Accordingly, we have found that the reed switches 40 may be conveniently supported and extended along the path of the carrier by the wires 70 themselves. However, an adjusting element 66 may be provided comprising a non-magnetic graduated steel tape or the like coiled in one end within adjusting element housing 48 and is similar to a retractable measuring tape capable of being retained in fixed extended positions. Wire 70 extends adjacent the path of the reed switch and is fixedly connected to a housing 42 which encapsulates the bias magnet 44 and reed switch 40 and is retained to adjusting element 66 by bracket 78 as illustrated in FIG. 3. FIG. 1A shows wires 70 protruding from the bottom of tube 36, but it will be understood that the wires extend out the end of the tubes 36 as in FIGS. 2 and 3.

FIG. 1A is schematic only and is intended to illustrate the operation of the system, not the mechanical design.

Figures 5, 6, 7, 8:
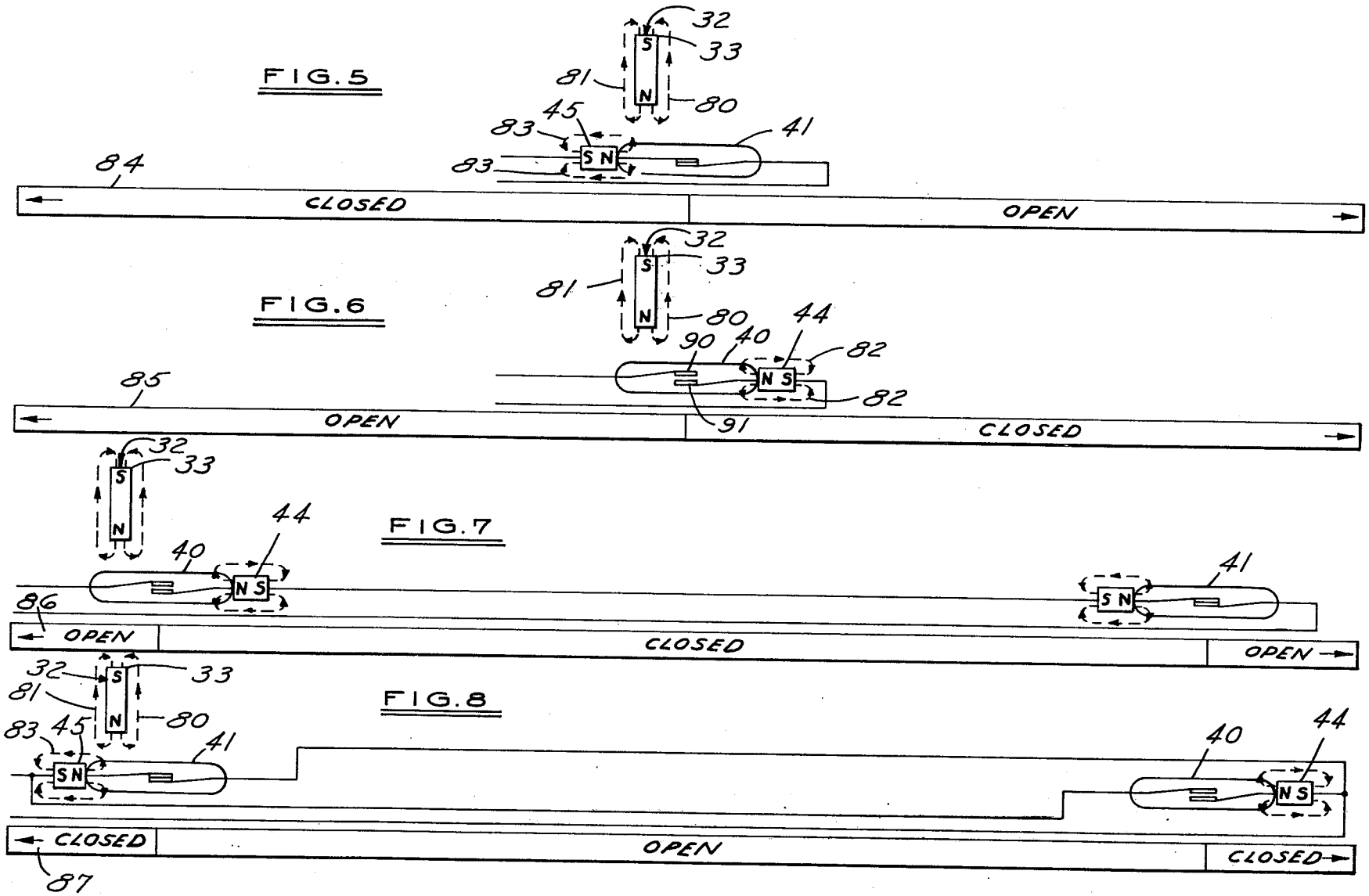
FIG. 5 is a fragmentary schematic cross-sectional view of a position sensing system with a reed switch shown in the closed position.
FIG. 6 is a fragmentary schematic cross-sectional view of a position sensing system with a reed switch shown in the open condition.
FIG. 7 is a fragmentary schematic cross-section of a position sensing system with a switch in the open condition and a switch in the closed condition in series.
FIG. 8 is a fragmentary schematic cross-section of a position sensing system with a switch in the closed condition and a switch in the open condition in parallel.

FIG. 1A, and more clearly FIG. 6, illustrates the operation of reed switches 40 and 40' as magnet means 32 reciprocates along the path of carrier movement. As magnet means 32 moves past switch 40, leading field portion 80, shown in cross sectional view in FIG. 6, first influences bias magnet 44. Since the field directions of leading field portion 80 and bias magnet field 82 are opposed, the switch remains open. As magnet 33 continues to move to the right, bias magnet field 82 is augmented by trailing field portion 81. The combination of these two fields provides sufficient magnetic strength to close the contacts of switch 40. Although the magnetic field of bias magnet 44 is insufficient to close the contacts, the field is of sufficient strength to retain the switch in a closed condition notwithstanding movement of magnet 33 such that it no longer influences bias magnet 44. Time bar 85 shows the approximate position where switch activation occurs. Closure of contacts 90, 91 completes a circuit actuating lamp 56.

As magnet means 32 continues to be propelled forward magnet 33 will influence switch 40' in the exact manner as switch 40. Trailing field 81 augments the bias field of bias magnet 44' closing switch 40' thereby activating lamp 54.

When magnet means 32 begins to move rearward from a position to the right of switch 40', field portion 81 will become leading field portion 81 and field portion 80 will become trailing field portion 80. As magnet 33 again influences switch 40', leading field portion 81 augments the bias magnet field of switch 40' thereby retaining the switch contacts in a latched condition. However, trailing field portion 80 exerts a field of opposite direction to that of the bias magnet field, thereby neutralizing the bias field allowing the contacts' inherent spring bias to open the switch. As magnet 33 influences switch 40, switch 40 and bias magnet 44 will be augmented and opposed alternatively in the same manner as was switch 40' thereby opening switch 40.

FIG. 5 illustrates the functioning of a reed switch shown in a closed condition as magnet means 32 sweeps by the reed switch 41. Referring to FIG. 5, the bias magnet 45 is placed on the left side of the switch 41 with its north pole facing the switch. As the magnet 33 approaches the switch from the left, leading field portion 80 augments bias magnet field 83 retaining the switch 41 in its closed condition. However, as magnet 33 reaches a position substantially midway the length of the reed switch, the direction of trailing field portion 81 of magnet 33 neutralizes bias field 83, thereby opening switch 41 as seen by time bar 84. Having opened the contacts, bias magnet 45 has insufficient strength to close the contacts, and they remain open as the carrier continues its forward travel. When the carrier moves rearward, field portion 81 becomes the leading field and field portion 80 becomes the trailing field. Consequently, as magnet 33 passes by switch 41, leading field portion 81 opposes bias magnet field 83 retaining switch 41 in an open condition. However, trailing field portion 80 once again augments bias magnet field 83 thereby closing the switch contacts.

A substantial advantage arising from the construction shown in FIGS. 1 through 6 is that the reed switches can be of different operating modes, viz., some being unlatched open and others being latched closed. For example, FIGS. 7 and 8 illustrate how these different operating modes could work using a combination of the switches illustrated in FIGS. 5 and 6. It will be noted that these switches could be in two guide tubes or in one, depending on the particular manufacturing environment. Time bar 86 illustrates the particular sequencing using the arrangement of FIG. 7. As magnet 33 moves to the right, switch 40 is actuated to a closed condition. The series circuit will be completed since switch 41 is showing a closed condition. If magnet 33 sweeps by switch 41 the circuit will once more be open since magnet 33 will open the closed switch 41. Time bar 87 illustrates the sequencing using the parallel arrangement in FIG. 8. As magnet 33 passes by switch 41 shown in a closed condition, switch 41 will open and by virtue of the open switch 40, the circuit appears open. When magnet 33 sweeps by switch 40, switch 40 will close once again completing the circuit.

Many other variations and arrangements can be presumed according to the direction that the bias magnet's north pole is aligned. Thus the bias magnet may be either to the right or left of the switch 40 and may either have its north pole or its south pole aligned radially inward depending on the response desired. Moreover, the sensing response of the machine control is quite accurate and demonstrates close sensitivity to the small horizontal movements of the carrier.

Figure 9:
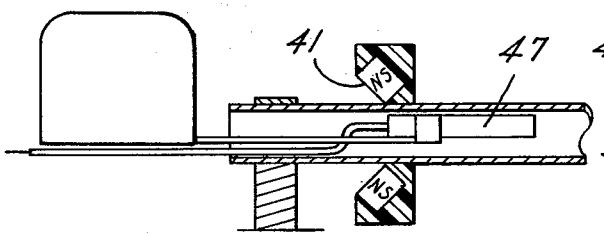
FIG. 9 is similar to FIG. 3 except that it illustrates the position sensing system with a self-latching reed switch.

Another form of reed switch assembly which can be used to effect a latching condition is shown in FIG. 9. This form of reed switch 47 has contacts made of a material capable of having a high residual magnetism, thereby providing a magnetic bias field for maintaining the switch in a closed condition despite the switch's inherent spring bias to an open condition. Consequently residual magnetism holds the switch closed independently of the distance the carrier moves away from the switch and independent of an external bias magnet. Moreover this form of reed switch can be latched closed by a strong magnetic field and unlatched by a weak field of reverse direction. Magnet 46 is similar to magnet 33 in FIGS. 2–4 except that the poles are inclined toward the axis of the reed switch thereby providing strong and weak magnet fields of opposite direction to latch and unlatch the self-latching reed switch 47. This type of reed switch assembly has been previously illustrated and described in detail in FIGS. 4–4E of our co-pending application, Ser. No. 627,518, filed Oct. 31, 1975, now U.S. Pat. No. 4,056,979 to which reference may be made for a more complete understanding of the theory of operation.

FIG. 4 is a cross-section showing the arrangement of the protective tubes 36 held adjacent to one another by bracket 62 and encircled by magnet means 32 including magnet 33. This view also shows the adjusting elements 66 and their housings 48. The adjusting elements allow for adjustably positioning the housings 48 which encapsulate their respective bias magnets and reeds.

What is claimed is:

1. In a position sensing system the combination comprising:

a carrier whose position is to be sensed, means supporting the carrier for movement along a predetermined path, a reed switch disposed adjacent said predetermined path and having reeds extending substantially parallel thereto, means for establishing a magnetic bias field across the reeds with its field strength sufficient to hold the reeds closed but insufficient to close them, and magnet means movable with the carrier adjacent said predetermined path for magnetically influencing said reed switch, said magnet means establishing a magnetic field having leading and trailing field portions of opposite direction for sweeping the switch reeds and one field portion augmenting the bias field to close the reeds as the magnet means passes the switch moving in one direction and the other field portion opposing the bias field opening the switch reeds as the magnet means passes the switch moving in the opposite direction at substantially the same point where the reeds were closed.

2. The invention defined by claim 1 characterized in that said means for establishing a magnetic bias field comprises a bias magnet disposed adjacent the switch.

3. The invention defined by claim 1 characterized in that said means for establishing a magnetic bias field comprises switch reeds having a residual magnetism sufficient to hold them closed following impression of a magnetic field sufficient to close them.

4. The invention defined by claim 1 characterized in that said magnet means comprises a plurality of magnets arranged in a circular configuration to surround the reed switch in radially extending relation therewith as the carrier passes the switch, said magnets having a common pole facing inwardly.

5. The invention defined by claim 1 characterized in that there are a plurality of said reed switches disposed in spaced apart relation along said path of travel.

6. The invention defined by claim 5 characterized in that there are a plurality of tubes extending adjacent to the said path of travel and having the switches disposed therein.

7. The invention defined by claim 6 characterized in that there is an elongated adjusting element extending into one end of the tube and connected to the reed switch for adjustably positioning the reed switch within the tube.

8. The invention defined by claim 1 characterized in that there are a plurality of said reed switches disposed in a plurality of tubes, said reed switches closing successively as the magnet means moves past each in one direction and opening successively as the magnet means moves past each in an opposite direction, and the said means for establishing a magnetic bias field is associated with each such switch for holding each of them closed while the magnet means moves past each such switch.

9. The invention defined by claim 1 characterized in that there are a plurality of said reed switches disposed in a plurality of tubes, said reed switches opening successively as the magnet means moves past each in one direction and closing successively as the magnet means moves past each in an opposite direction, and said means for establishing a magnetic bias field is associated with each such switch for holding each of them closed while the magnet means moves to the rearward of them.

10. The invention defined by claim 1 characterized in that there are a plurality of said reed switches in a plurality of tubes with at least one of said reed switches closing and at least one of said reed switches opening as the magnet means moves past them in one direction and conversely opening the closed one of them and closing the open one of them as the magnet means moves past them in an opposite direction and said means for establishing a magnetic bias field is associated with each such switch for holding each such switch in its closed position while the magnet means moves away from it continuing in the same direction as that in which it was moving when the switch was closed.

11. The invention defined by claim 1 characterized in that there are a plurality of reed switches disposed in a plurality of guide tubes and means for establishing a magnetic bias field across the reeds of each switch comprising a permanent bias magnet in the tube adjacent the reed switch with like poles of each bias magnet facing radially inwardly of the guide tube and the corresponding pole of the magnet on the carrier facing the switch.

12. The invention defined by claim 1 characterized in that said magnet means establishes a symmetrical toroidal magnetic field having leading and trailing field portions of opposite direction for sweeping the switch reeds and augmenting the bias field to close the reeds as the magnet means passes the switch moving in one direction and sweeping and overcoming the bias field opening the switch reeds as the magnet means passes the switch moving in the opposite direction at substantially the same point where the reeds were closed.

13. The invention defined by claim 12 characterized in that the axis of the symmetrical toroidal magnetic field extends parallel to the said predetermined path.

14. The invention defined by claim 3 characterized in that said magnetic means comprises a magnet arranged in an inclined array with one pole extending radially toward the reed switch and the other pole extending radially outwardly from the reed switch.

* * * * *